US012480684B2

(12) United States Patent
Shin et al.

(10) Patent No.: US 12,480,684 B2
(45) Date of Patent: Nov. 25, 2025

(54) AIR CONDITIONER

(71) Applicant: Samsung Electronics Co., Ltd., Suwon-si (KR)

(72) Inventors: Kwangnam Shin, Suwon-si (KR); Jeongkyo Oh, Suwon-si (KR); Donghyun Kim, Suwon-si (KR); Hyundal Kim, Suwon-si (KR); Dongkung Oh, Suwon-si (KR); Dongsu Ha, Suwon-si (KR); Jinwoo Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 373 days.

(21) Appl. No.: 18/325,578

(22) Filed: May 30, 2023

(65) Prior Publication Data

US 2023/0304700 A1 Sep. 28, 2023

Related U.S. Application Data

(63) Continuation of application No. PCT/KR2021/018468, filed on Dec. 7, 2021.

(30) Foreign Application Priority Data

Dec. 23, 2020 (KR) ..... 10-2020-0181870

(51) Int. Cl.
*F24F 13/14* (2006.01)

(52) U.S. Cl.
CPC ..... *F24F 13/1413* (2013.01); *F24F 2221/14* (2013.01)

(58) Field of Classification Search
CPC ..... F24F 13/1413
See application file for complete search history.

(56) References Cited

U.S. PATENT DOCUMENTS 5,194,043 A * 3/1993 Takahashi ..... F24F 11/74 454/316
10,969,122 B2 4/2021 Kim et al.
(Continued)

FOREIGN PATENT DOCUMENTS

CN 203443044 U 2/2014
CN 106287971 A 1/2017
(Continued)

OTHER PUBLICATIONS

International Search Report dated Apr. 6, 2022, issued in International Patent Application No. PCT/KR2021/018468.
(Continued)

*Primary Examiner* — Allen R. B. Schult
(74) *Attorney, Agent, or Firm* — Jefferson IP Law, LLP

(57) ABSTRACT

An air conditioner is provided. The air conditioner includes a housing comprising a discharge port, a fan disposed inside the housing to blow air into the discharge port, a main blade disposed in the discharge port to be rotatable by a driving motor, the main blade comprising a blocking plate and a guide blade arranged at a first distance from the blocking plate along a rotation direction of the main blade so as to form a blowing flow path through the first distance according to a rotation angle of the main blade, and a sub-blade configured to be rotated along a circumference of the main blade by interlocking with the main blade, the sub-blade arranged in the rotation direction of the main blade with respect to the blocking plate and provided to cover the discharge port together with the blocking plate according to the rotation angle of the main blade.

15 Claims, 13 Drawing Sheets

(56) References Cited

U.S. PATENT DOCUMENTS

| | | | |
|---|---|---|---|
| 11,085,651 | B2 | 8/2021 | Kwon |
| 11,448,419 | B2 | 9/2022 | Kang et al. |
| 2014/0308887 | A1 | 10/2014 | Yoon et al. |

FOREIGN PATENT DOCUMENTS

| | | | | |
|---|---|---|---|---|
| CN | 210601925 | U | * | 5/2020 |
| CN | 107796048 | B | | 7/2020 |
| EP | 1 629 236 | A0 | | 3/2006 |
| JP | H06-137662 | A | | 5/1994 |
| JP | 2007-205711 | A | | 8/2007 |
| JP | 2011-047571 | A | | 3/2011 |
| KR | 10-0244314 | B1 | | 3/2000 |
| KR | 20-0182142 | Y1 | | 5/2000 |
| KR | 10-2003-0035116 | A | | 5/2003 |
| KR | 10-2004-0104901 | A | | 12/2004 |
| KR | 20-0443817 | Y1 | | 3/2009 |
| KR | 10-2009-0061379 | A | | 6/2009 |
| KR | 10-1718221 | B1 | | 3/2017 |
| KR | 10-2018-0125425 | A | | 11/2018 |
| KR | 10-2019-0032940 | A | | 3/2019 |
| KR | 10-2019-0042201 | A | | 4/2019 |
| KR | 10-2019-0084635 | A | | 7/2019 |
| KR | 10-2040800 | B1 | | 12/2019 |
| KR | 10-2105584 | B1 | | 4/2020 |
| KR | 10-2020-0089363 | A | | 7/2020 |

OTHER PUBLICATIONS

Korean Office Action dated Jan. 31, 2025, issued in a Korean Patent Application No. 10-2020-0181870.

* cited by examiner

AIR CONDITIONER

CROSS-REFERENCE TO RELATED APPLICATION(S)

This application is a continuation application, claiming priority under § 365(c), of an International application No. PCT/KR2021/018468, filed on Dec. 7, 2021, which is based on and claims the benefit of a Korean patent application number 10-2020-0181870, filed on Dec. 23, 2020, in the Korean Intellectual Property Office, the disclosure of which is incorporated by reference herein in its entirety.

BACKGROUND

1. Field

The disclosure relates to an air conditioner. More particularly, the disclosure relates to a ceiling-type air conditioner including a blade structure configured to control a direction of airflow discharged from an indoor unit.

2. Description of Related Art

In general, an air conditioner is a device that uses a refrigeration cycle to adjust temperature, humidity, airflow, distribution, etc. suitable for human activity. A compressor, a condenser, an evaporator, a fan, and the like, are provided as main components forming the refrigeration cycle.

The air conditioners may be classified into a separate type-air conditioner in which an indoor unit and an outdoor unit are installed separately, and an integral type-air conditioner in which an indoor unit and an outdoor unit are installed together in a single cabinet. The indoor unit of the separate type-air conditioner includes a heat exchanger configured to exchange heat with air sucked into a panel, and a fan configured to suck indoor air into the panel and blow the sucked air back into an indoor space.

The air introduced into the indoor unit by the fan is discharged to the outside of the indoor unit through a discharge port. The air conditioner includes a blade configured to control a discharge direction of the discharged air.

In a conventional air conditioner, a blade is provided in a plate shape, and when the blade is provided in plurality, each blade may be driven by being connected by a link.

When a perforated structure is applied to a surface of the plate-shaped blade to implement a windless airflow in a state in which an air outlet is covered, a structural rigidity of the plate-shaped blade may be reduced.

In addition, when the air is rotated in place around a single rotation axis to change the direction of the air, a range of direction for guiding the air may become narrow.

A discharge direction of the air is guided by one surface of the blade, and thus it may be difficult to concentrate and discharge the air to a direct downward direction of an air purifier.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an air conditioner capable of securing a structural rigidity of a blade configured to guide heat-exchanged air.

Another aspect of the disclosure is to provide an air conditioner capable of effectively controlling a discharge direction of air by reducing the number of components of a blade and by including a relatively simple structure.

Another aspect of the disclosure is to provide a ceiling type-air conditioner capable of effectively discharging heat-exchanged air in a direct downward direction with respect to a position in which the air conditioner is installed.

Additional aspects will be set forth in part in the description which follows and, in part, will be apparent from the description, or may be learned by practice of the presented embodiments.

In accordance with an aspect of the disclosure, an air conditioner including a housing is provided. The air conditioner includes a discharge port, a fan disposed inside the housing to blow air into the discharge port, a main blade disposed in the discharge port to be rotatable by a driving motor, the main blade including a blocking plate and a guide blade arranged at a first distance from the blocking plate along a rotation direction of the main blade so as to form a blowing flow path through the first distance according to a rotation angle of the main blade, and a sub-blade configured to be rotated along a circumference of the main blade by interlocking with the main blade, the sub-blade arranged in the rotation direction of the main blade with respect to the blocking plate and provided to cover the discharge port together with the blocking plate according to the rotation angle of the main blade.

The sub-blade includes a plurality of holes through which the air is discharged to an outside of the housing.

Air may be discharged to the outside of the housing at a low speed through the plurality of holes in a first mode in which the blocking plate and the sub-blade cover the discharge port.

The main blade may be provided to allow the blocking plate to overlap the sub-blade in a second mode in which the main blade is rotated by a first angle in a first direction.

The blowing flow path may be opened toward the discharge port to discharge air to the outside of the housing.

The blowing flow path may be opened toward the discharge port to allow air to be discharged directly downward from the air conditioner in a third mode in which the main blade is rotated by a second angle in the first direction.

In a process in which the main blade is rotated from the first angle to the second angle, the main blade may interlock with the sub-blade to rotate the sub-blade in the first direction.

In a process in which the main blade is rotated from the first angle to the second angle, the blocking plate and the sub-blade may be rotated together in an overlapped state.

In the third mode, the main blade may be accommodated inside the housing while overlapping the sub-blade.

The guide blade may include a plurality of sub-guide blades.

The plurality of sub-guide blades may be spaced apart from each other by a predetermined distance in the rotation direction.

Each of the plurality of sub-guide blades may be inclined in a direction toward a distance formed between the blocking plate 111 and the guide blade 112 based on a radial direction.

The sub-blade may be arranged at a second distance in the radial direction from an outer circumference of the main blade.

The main blade further includes a first interlocking part radially protruding from the main blade toward the sub-blade.

The sub-blade further includes a second interlocking part protruding from the sub-blade and provided to correspond to the first interlocking part.

The first interlocking part may protrude to correspond to the second distance to allow the main blade and the sub-blade to interlock with each other.

The second interlocking part may include a first protrusion and a second protrusion.

The first protrusion and the second protrusion may be disposed at a third distance in the rotation direction of the main blade to allow the main blade and the sub-blade to interlock with each other within a predetermined range of the rotation angle of the main blade.

The main blade further includes a rotating plate provided to fix both ends of the blocking plate and the guide blade.

A rim of the rotating plate may be provided to correspond to circumferences of the both ends of the main blade.

The first interlocking part may protrude from the rim of the rotating plate.

The main blade further includes a first connector protruding from the rotating plate and connected to a rotation shaft of the motor.

The sub-blade further includes a second connector including a hole into which the first connector is inserted, the second connector connected to both ends of the sub-blade.

An inner side of the hole of the second connector may be in contact with an outer side of the first connector.

The second connector may further include teeth formed along a rim of the hole.

The air conditioner includes a damper including a gear provided to engage with the teeth.

The damper may be provided to apply a force to the sub-blade in an opposite direction to a rotation direction of the sub-blade.

The air conditioner further includes a stopper protruding from the housing and arranged on a rotation path of the sub-blade so as to limit rotation of the sub-blade.

Another aspect of the present disclosure provides an air conditioner including a suction port provided to suck air, a heat exchanger configured to exchange heat between the sucked air and a refrigerant, a fan configured to transport the heat-exchanged air to a discharge port, and a blade disposed in the discharge port to be rotatable by a driving motor and provided to guide movement of the air discharged to the discharge port.

The blade includes a main blade including a blocking plate, a guide blade arranged at a first distance from the blocking plate along a rotation direction of the main blade, and a rotating plate formed in a disk shape and provided to fix both ends of the blocking plate and the guide plate, and a sub-blade including a plurality of holes and configured to be rotated along a circumference of the main blade by interlocking with the main blade, the sub-blade arranged in the rotation direction with respect to the blocking plate and provided to cover the discharge port together with the blocking plate.

As the main blade is rotated, the main blade may interlock with the sub-blade so as to rotate the sub-blade.

The sub-blade may be arranged at a second distance in a radial direction from an outer circumference of the main blade.

The main blade further includes a first interlocking part radially protruding from the rotating plate toward the sub-blade.

The sub-blade further includes a second interlocking part protruding from the sub-blade and provided to correspond to the first interlocking part.

The first interlocking part may protrude to correspond to the second distance to allow the main blade and the sub-blade to interlock with each other.

The second interlocking part includes a first protrusion and a second protrusion.

The first protrusion and the second protrusion may be disposed at a third distance in the rotation direction to allow the main blade and the sub-blade to interlock with each other within the predetermined rotation angle.

The main blade, may be provided to allow the first interlocking part to interlock with the first protrusion in response to the rotation of the main blade in a first direction, and provided to allow the first interlocking part to interlock with the second protrusion in response to the rotation of the main blade in a second direction opposite to the first direction.

Air may be discharged to the outside of the housing at a low speed through the plurality of holes in a first mode in which the blocking plate and the sub-blade cover the discharge port.

The main blade, may be provided to allow the blocking plate and the guide plate to form a blowing flow path through the first distance, may be provided to allow the blocking plate to overlap the sub-blade in a second mode in which the main blade is rotated by a first angle in a first direction, and provided to allow the blowing flow path to be opened toward the discharge port to discharge air to the outside of the housing, and may be provided to allow the blowing flow path to be opened toward the discharge port to allow air to be discharged directly downward from the air conditioner in a third mode in which the main blade is rotated by a second angle in the first direction.

A plurality of blades and a circular plate supporting the plurality of blades are coupled to form a cylinder shape as a whole. Accordingly, a structural rigidity may be improved in comparison with a plate-type blade. Further, even when a plurality of holes is formed on a surface of the blade to implement a windless airflow, the blade may guide air to the outside without being twisted.

By a simple structure in which a main blade and a sub-blade are rotatably coupled to form a cylindrical shape as a whole, it is possible to effectively control a discharge direction of air. Further, in an air conditioner installed on a ceiling, it is possible to effectively discharge heat-exchanged air to a direct downward direction with respect to a position in which the air conditioner is installed.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an" and "the" include plural referents unless the context clearly indicates otherwise. Thus, for example, reference to "a component surface" includes reference to one or more of such surfaces.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper portion", "lower portion", "upper end", "lower end" "upper surface", "lower surface" and the like may be defined by the drawings, but the shape and the location of the component is not limited by the term.

In addition, a fan described below that is applied to a ceiling type-air conditioner will be described as an example, but the fan may be applied to other types of air conditioners such as a stand type-air conditioner or a wall-mounted air conditioner, and other home appliances such as a refrigerator or a vacuum cleaner.

Hereinafter exemplary embodiments of the disclosure will be described in detail with reference to the accompanying drawings.

Figure 1:
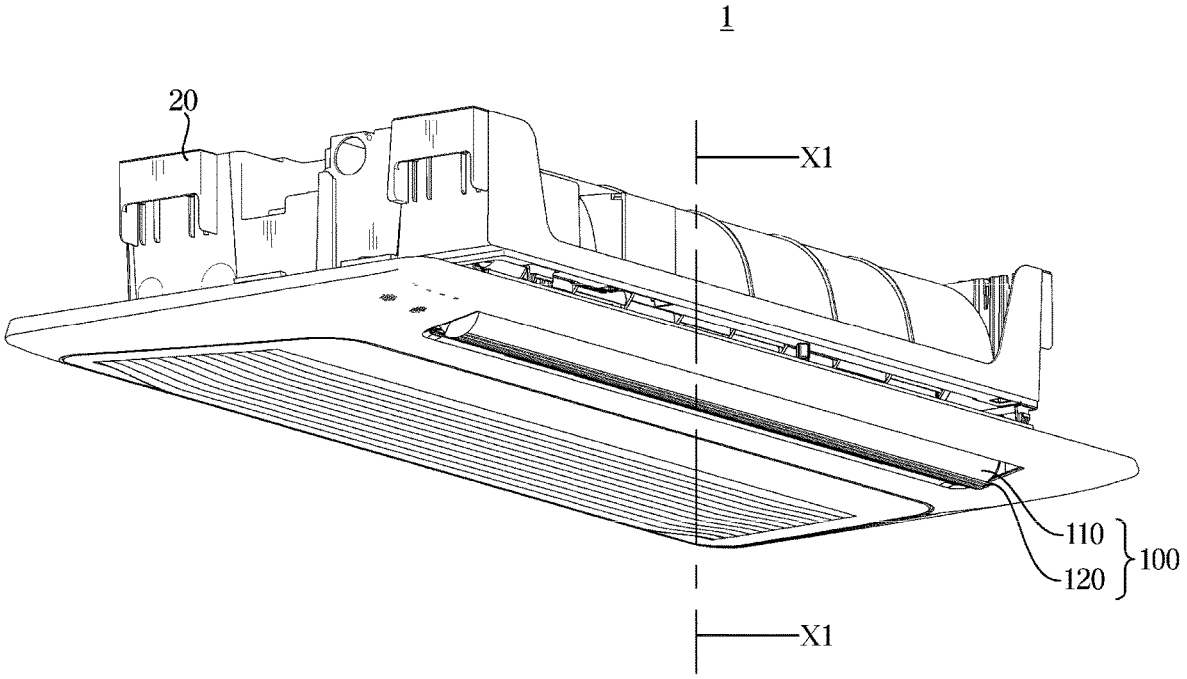
FIG. 1 is a perspective view illustrating an air conditioner according to an embodiment of the disclosure.

FIG. 1 is a perspective view illustrating an air conditioner according to an embodiment of the disclosure.

Figure 2:
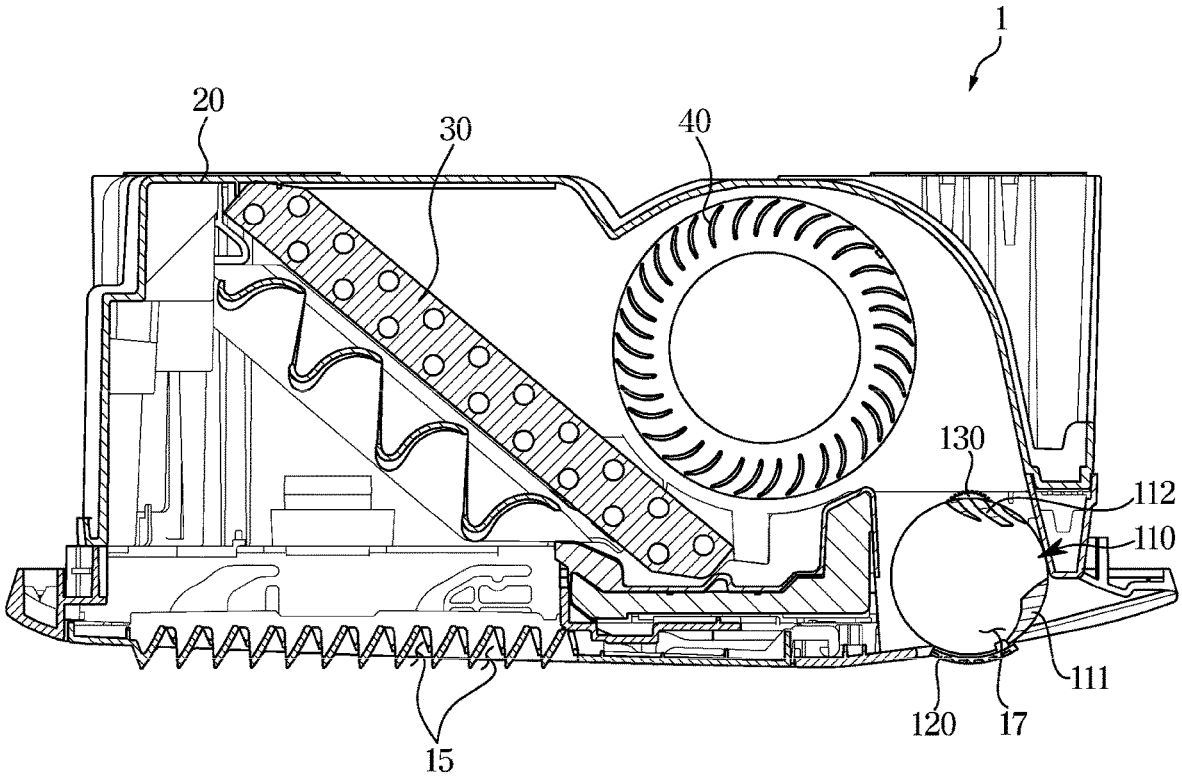
FIG. 2 is a cross-sectional view of the air conditioner of FIG. 1 taken along line X1-X1 according to an embodiment of the disclosure.

FIG. 2 is a cross-sectional view of the air conditioner of FIG. 1 taken along line X1-X1 according to an embodiment of the disclosure.

Figure 3:
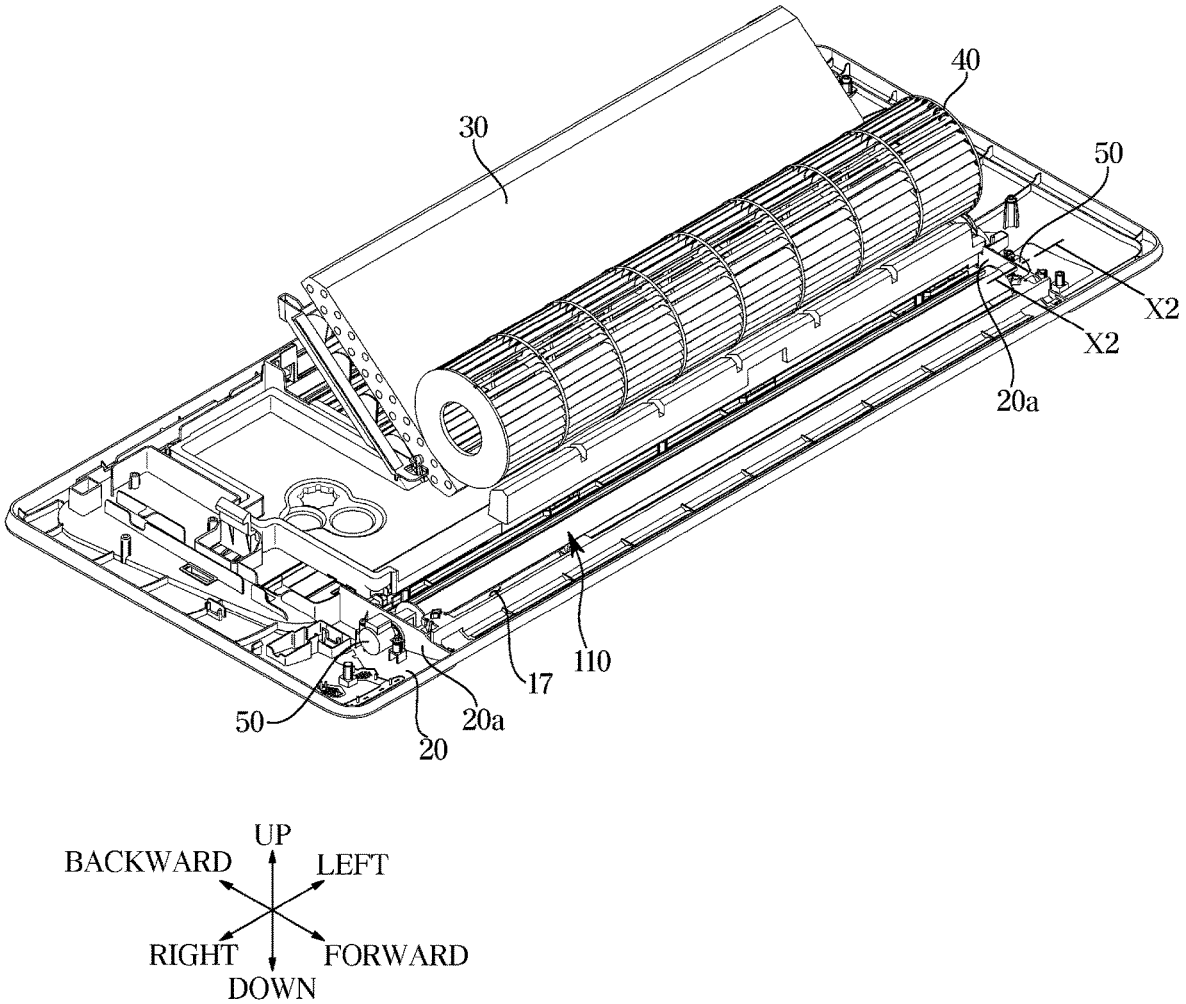
FIG. 3 is a perspective view of an air conditioner from which an upper portion of a housing removed according to an embodiment of the disclosure.

FIG. 3 is a perspective view of an air conditioner from which an upper portion of a housing removed according to an embodiment of the disclosure.

Figure 4:
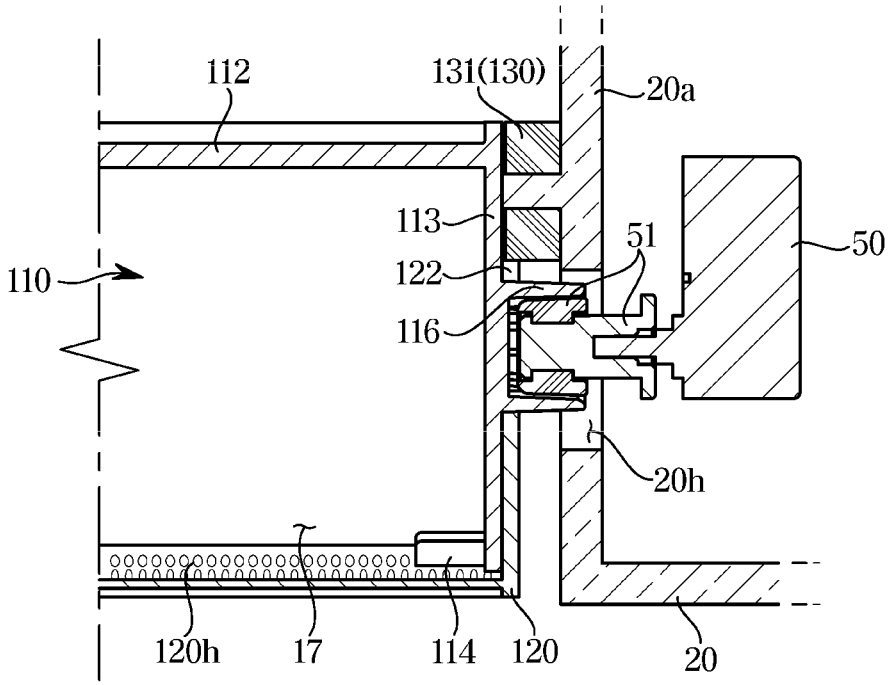
FIG. 4 is a cross-sectional view of the air conditioner of FIG. 3 taken along line X2-X2 according to an embodiment of the disclosure.

FIG. 4 is a cross-sectional view of the air conditioner of FIG. 3 taken along line X2-X2 according to an embodiment of the disclosure.

Referring to FIGS. 1 and 2, an air conditioner 1 includes a housing 20 including a suction port 15 and a discharge port 17, a heat exchanger 30 configured to exchange heat with air introduced into the housing 20, and a blowing fan 40 configured to circulate air to the inside or outside of the housing 20.

The air conditioner 1 exemplified in the disclosure is a ceiling type-air conditioner 1 that is suspended or embedded in a ceiling, but is not limited thereto.

The housing 20 may be formed to form an overall appearance of the air conditioner 1.

The blowing fan 40 may be disposed inside the housing 20. The blowing fan 40 may be a cross flow fan having the same longitudinal direction as a longitudinal direction of the housing 20. The blowing fan 40 may blow air so as to suck air from the suction port 15 and to discharge the air to the discharge port 17.

The heat exchanger 30 is disposed, for example, adjacent to the blowing fan 40, and it is appropriate that the heat exchanger 30 is disposed between the suction port 15 and the blowing fan 40. Accordingly, outside air may be sucked into the suction port 15, exchange heat with the heat exchanger 30, and then discharged to the outside through the discharge port 17.

The discharge port 17 may be formed on one surface of the housing 20 and may be provided to be opened toward the lower side of the air conditioner 1. The discharge port 17 may be provided in a shape cut parallel to a longitudinal direction of one surface of the housing 20. When the air conditioner 1 is installed on a ceiling, the one surface may be a lower surface of the housing 20.

The air conditioner 1 may include a blade 100 configured to open and close the discharge port 17. The blade 100 can be rotatably provided in the housing 20. The blade 100 may be configured to be rotated around a rotation axis of the blade 100. The rotation axis of the blade 100 may be located inside the housing 20. Hereinafter a rotation direction R may refer to a rotation direction of the blade 100, that is, a main blade 110 or a sub-blade 120.

The blade 100 may include the main blade 110 configured to guide movement of air, and the sub-blade 120 coupled to the main blade 110 and configured to guide the movement of air together with the main blade 110.

The main blade 110 may be rotatably arranged in the discharge port 17. The main blade 110 may be provided in a shape corresponding to the discharge port 17. The main blade 110 may be formed to extend in a direction parallel to the discharge port 17.

As described later, the main blade 110 may include a blocking plate 111 and a guide blade 112. The blocking plate 111 or the guide blade 112 may be provided in a shape corresponding to the discharge port 17. The blocking plate 111 or the guide blade 112 may be formed to extend in a direction parallel to the discharge port 17.

The blocking plate 111 and the guide blade 112 may be spaced apart in the rotation direction R of the blade 100.

The main blade 110 may further include a disk-shaped rotating plate 113 provided to fix both ends of the blocking plate 111 and the guide blade 112. The blocking plate 111 and the guide blade 112 may be disposed along a rim of the rotating plate 113. The rotating plate 113 may fix the both ends of the blocking plate 111 and the guide blade 112 to allow the blocking plate 111 and the guide blade 112 to be arranged while maintaining a distance between the blocking plate 111 and the guide blade 112.

The sub-blade 120 may be rotatably disposed in the discharge port 17. The sub-blade 120 may be coupled to the main blade 110 so as to be rotatable along a circumference of the main blade 110. The sub-blade 120 and the main blade 110 may be provided to be rotatable based on the same rotation axis. In the blade 100 disclosed in the drawing of the disclosure, it is illustrated that the main blade 110 and the sub-blade 120 are rotated about the same rotation axis, but is not limited thereto. That is, as long as the sub-blade 120 is configured to be rotated along a certain region around the main blade 110, the main blade 110 and the sub-blade 120 may be rotatably provided based on different rotation axes.

The sub-blade 120 may have a shape corresponding to that of the main blade 110. Like the main blade 110, the sub-blade 120 may be provided in a shape corresponding to the discharge port 17. The sub-blade 120 may be formed to extend in a direction parallel to the discharge port 17.

As will be described later, the sub-blade 120 may be disposed in the rotation direction R with respect to the blocking plate 111 according to a rotation angle of the main blade 110, so as to cover the discharge port 17 together with the blocking plate.

A plurality of holes **120*h* may be formed on a surface of the sub-blade 120**. A detailed structure will be described later.

The blade 100 including the main blade 110 and the sub-blade 120 may be provided in a substantially cylindrical shape.

The blocking plate 111, the guide blade, and the sub-blade 120 may be disposed in the rotation direction R of the blade 100 and may be disposed along the side surface of the cylindrical shape. The rotating plate 113 may be disposed at both ends of the cylindrical shape.

The air conditioner 1 may further include a driving motor 50 connected to the main blade 110 to rotate the main blade 110. A variable reluctance type stepping motor having excellent rotation angle resolution may be applied to the driving motor 50. When the variable reluctance type stepping motor is used, it is possible to freely implement a swing mode requiring continuous direction change as well as step-by-step direction change of the blade 100. However, it is not limited thereto, and as long as the driving motor 50 is configured to implement step-by-step direction change and continuous direction change of the blade 100, particularly, the main blade 110, any power device may be used as the driving motor 50.

Referring to FIG. 3, the driving motor 50 may be connected to the both ends of the main blade 110. Although FIG. 3 illustrates a structure in which two driving motors 50 connected to the both ends of the main blade 110 are provided, it is not limited thereto. Alternatively, a single driving motor 50 may be provided only on either end of both ends. The driving motor 50 may be fixed to the housing 20 as shown in FIG. 3.

The main blade 110 may include a connector protruding from the both ends of the main blade 110. Particularly, the main blade 110 may further include a connector protruding from the rotating plate 113 disposed at the both ends of the main blade 110. The main blade 110 may be connected to a rotation shaft of the driving motor 50 through the connector. A detailed structure of the connector will be described later.

Referring to FIGS. 3 and 4, the driving motor 50 may be connected to the main blade 110 with a housing inner sidewall **20*a*, which is formed inside the housing 20, interposed therebetween. The housing inner sidewall 20*a* may be provided in a structure protruding upward from a lower surface of the housing 20**.

Because the driving motor 50 and the main blade 110 are connected with the housing inner sidewall **20*a* interposed therebetween and provided to be rotatable, the housing inner sidewall 20*a* may include a housing hole 20*h* in a position corresponding to a portion in which the driving motor 50 and the main blade 110 are connected. The main blade 110 and the driving motor 50 may be connected through the housing hole 20*h* to penetrate the housing inner sidewall 20*a***.

The plurality of blades and the circular plate supporting the plurality of blades are combined to form a cylindrical shape by using the above-described structure, and thus the structural rigidity may be improved in comparison with a plate-shaped blade.

In addition, although the plurality of holes is formed on the surface of the blade to implement a windless airflow, the blade may guide air to the outside without being twisted.

Figure 5:
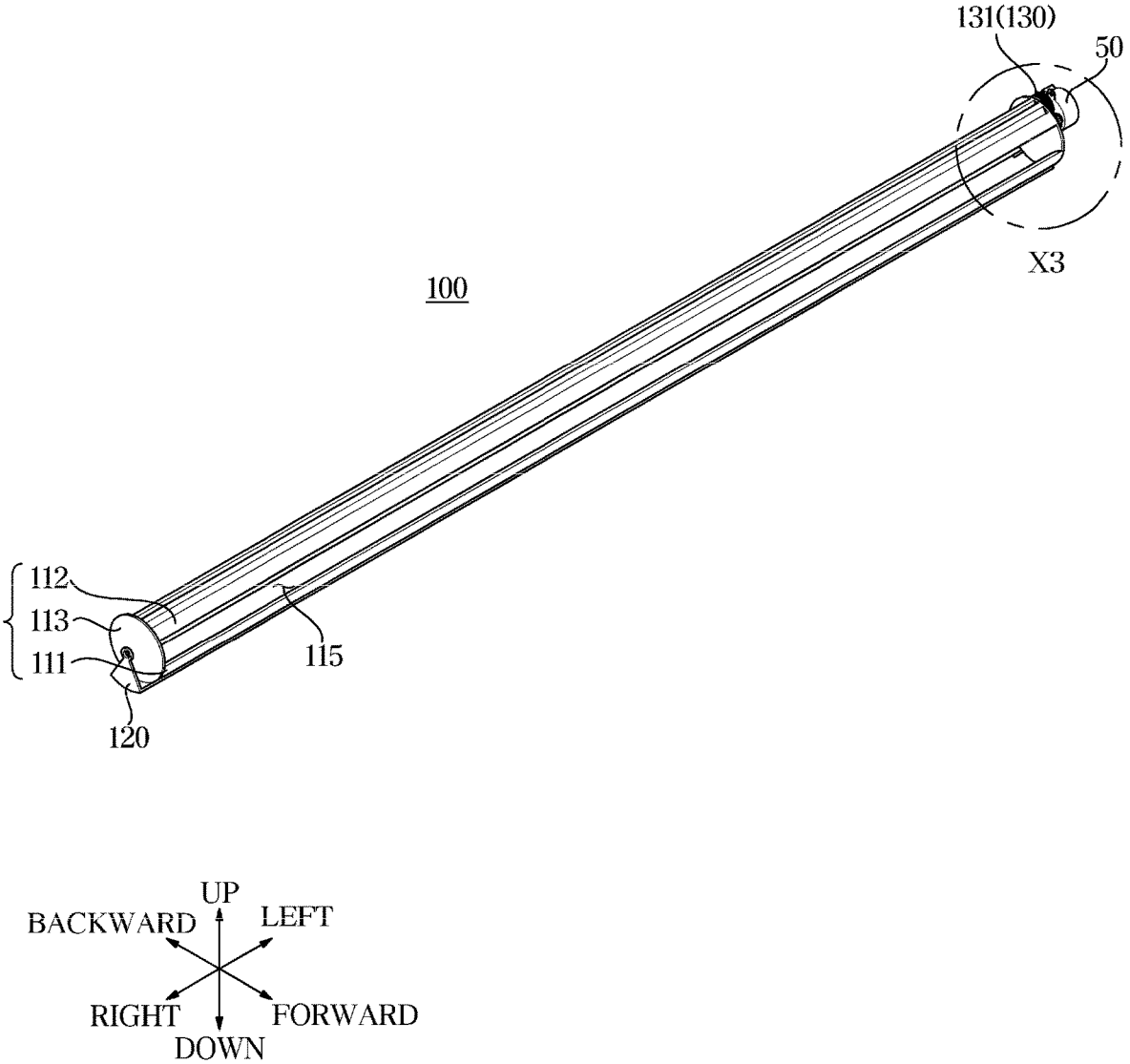
FIG. 5 is a perspective view illustrating a state in which a blade, a driving motor, and a damper of an air conditioner are coupled according to an embodiment of the disclosure.

FIG. 5 is a perspective view illustrating a state in which a blade, a driving motor, and a damper of the air conditioner are coupled according to an embodiment of the disclosure.

Figure 6:
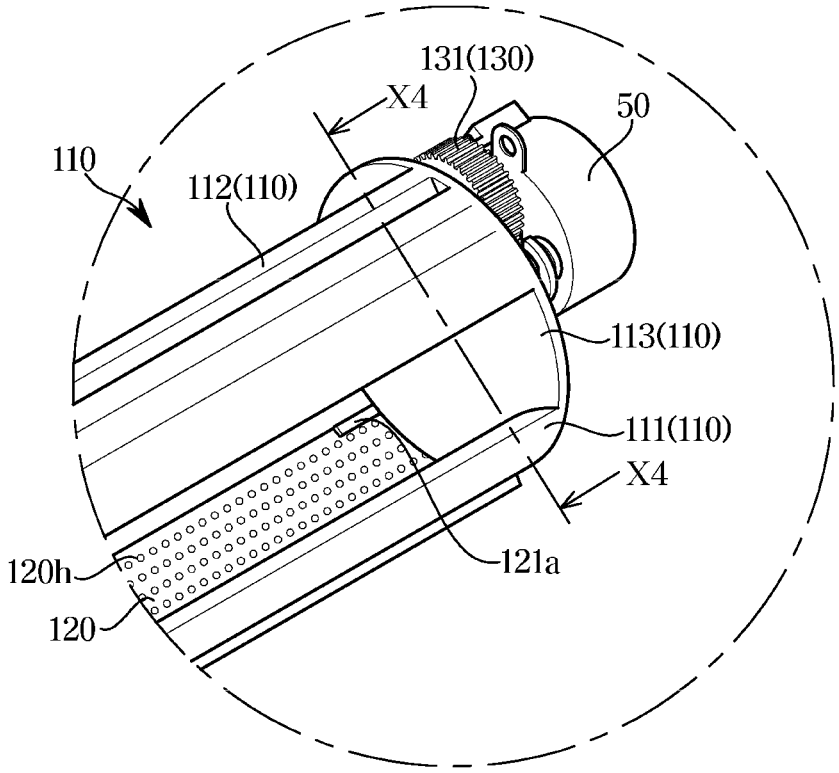
FIG. 6 is an enlarged view of a region X3 of FIG. 5 according to an embodiment of the disclosure.

FIG. 6 is an enlarged view of a region X3 of FIG. 5 according to an embodiment of the disclosure.

Figure 7:
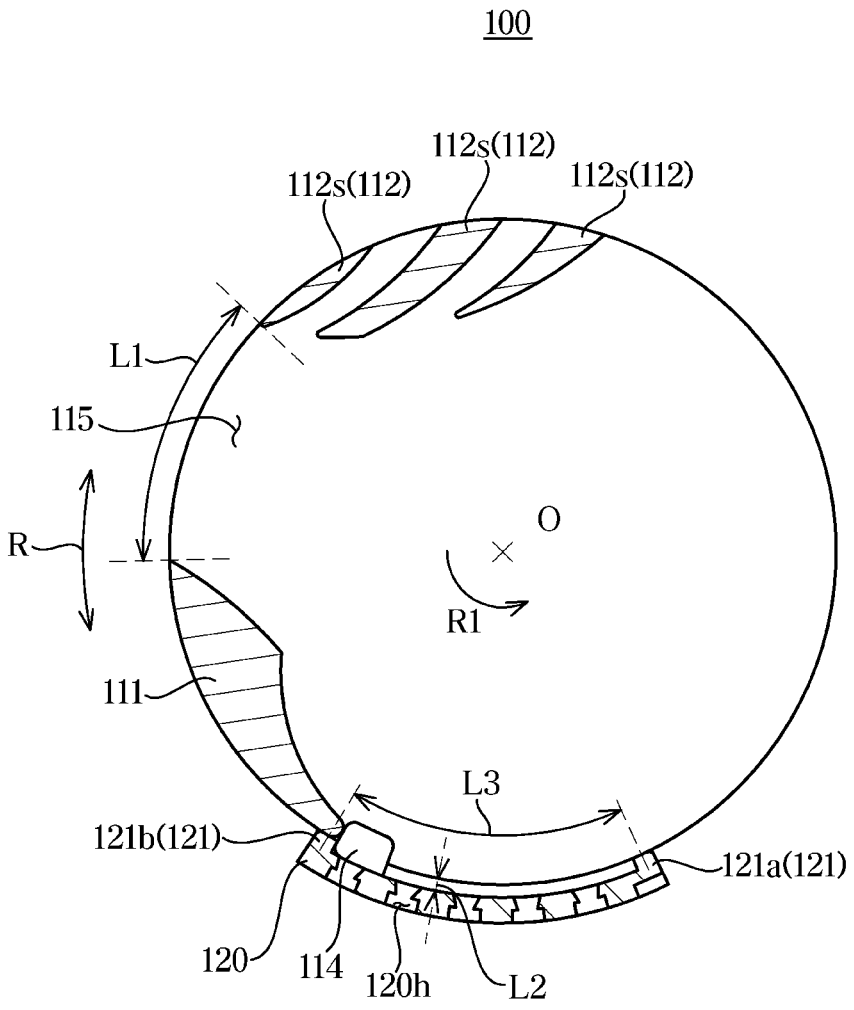
FIG. 7 is a cross-sectional view of the blade of FIG. 6 taken along line X4-X4 according to an embodiment of the disclosure.

FIG. 7 is a cross-sectional view of the blade of FIG. 6 taken along line X4-X4 according to an embodiment of the disclosure.

Figure 8:
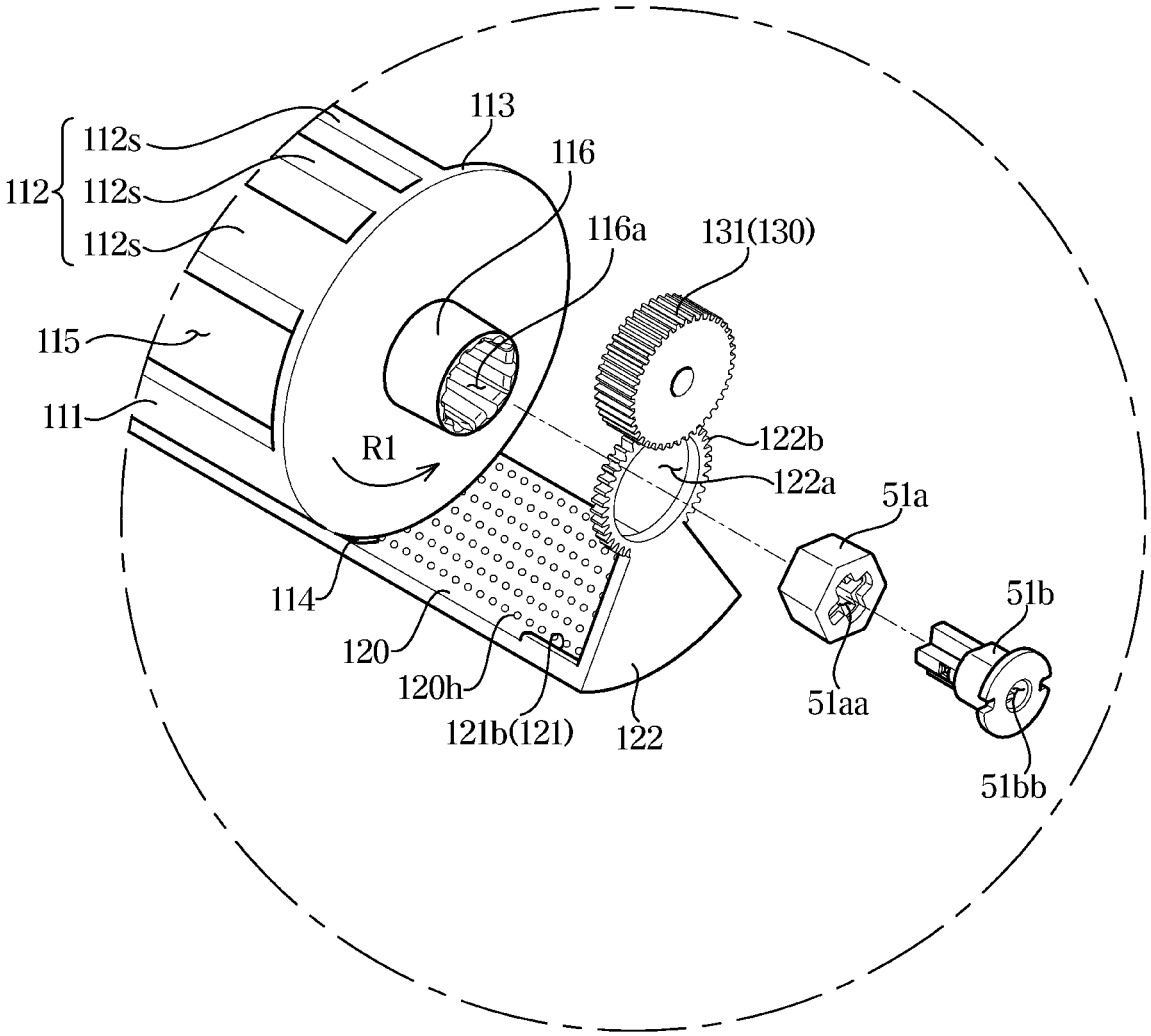
FIG. 8 is an exploded perspective view of a blade of an air conditioner according to an embodiment of the disclosure.

FIG. 8 is an exploded perspective view of the blade of an air conditioner according to an embodiment of the disclosure.

Figure 9:
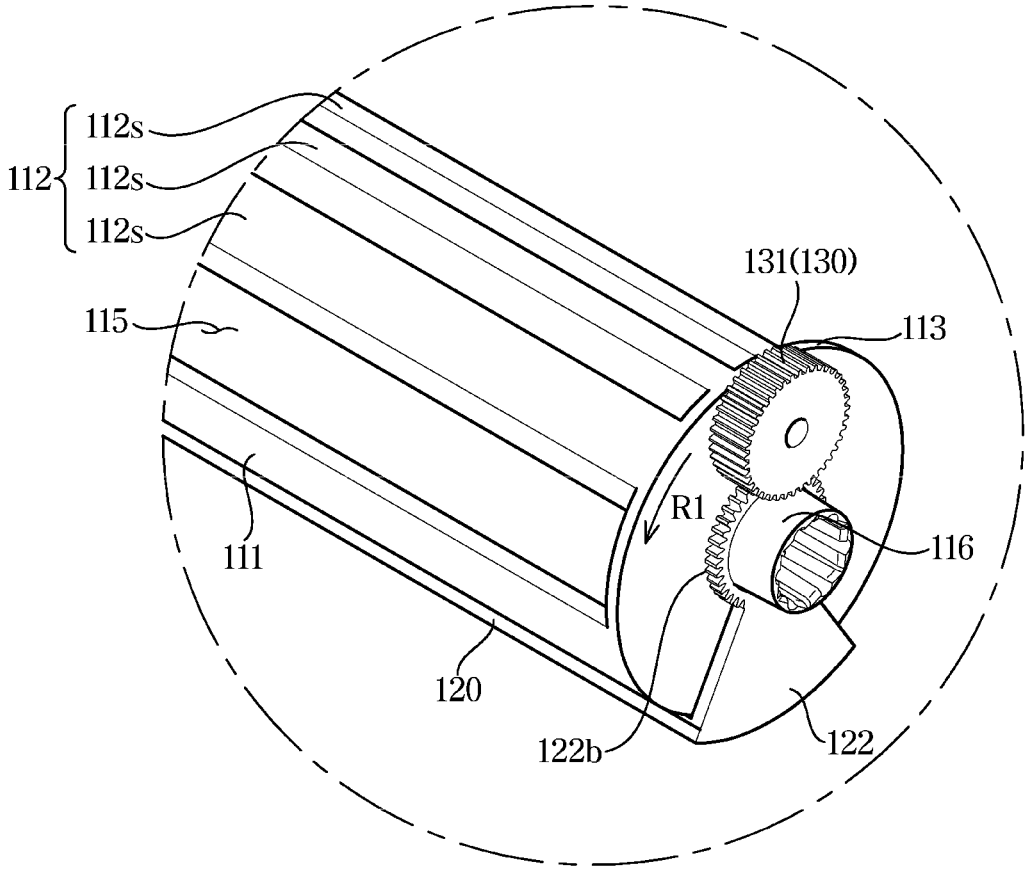
FIG. 9 is a perspective view illustrating a state in which components of FIG. 8 are coupled according to an embodiment of the disclosure.

FIG. 9 is a perspective view illustrating a state in which components of FIG. 8 are coupled according to an embodiment of the disclosure.

Figure 10:
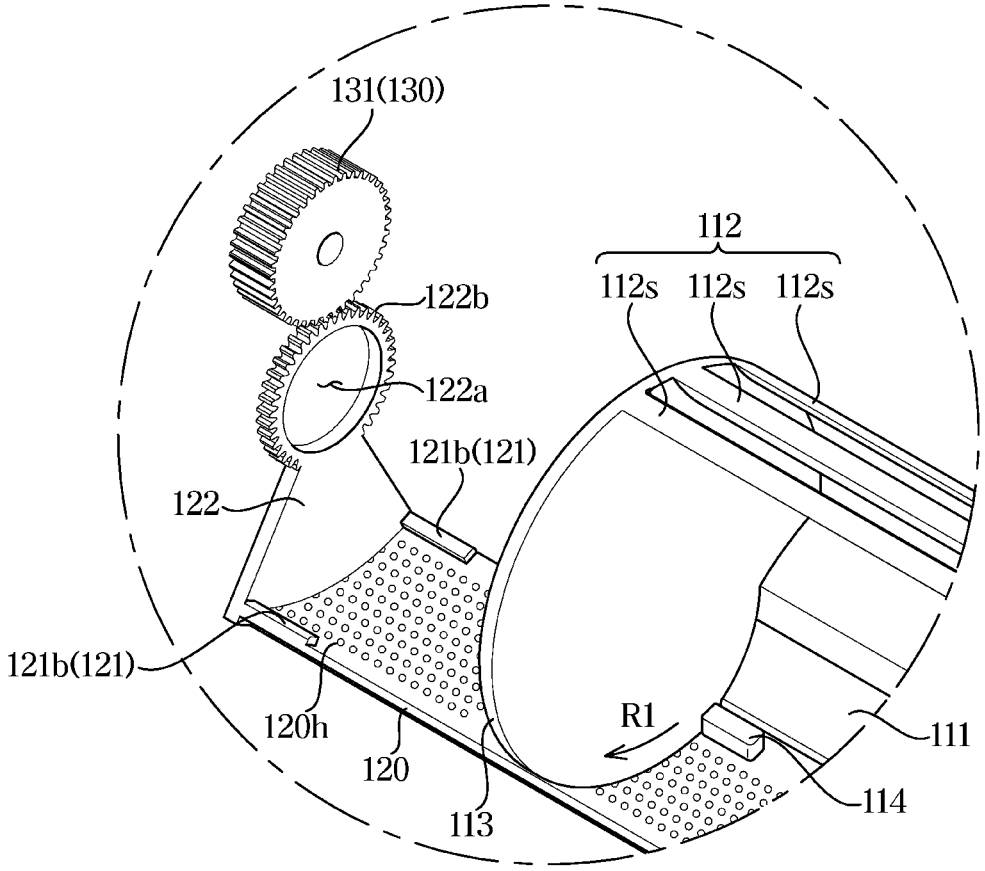
FIG. 10 is a perspective view of the blade of FIG. 8 when viewed from another direction according to an embodiment of the disclosure.

FIG. 10 is a perspective view of the blade of FIG. 8 when viewed from another direction according to an embodiment of the disclosure.

Hereinafter the structure of the blade according to the disclosure will be described in detail.

Referring to FIGS. 5-10, the blade 100 may be rotatably disposed on the discharge port 17 while covering the discharge port 17. The blade 100 may be formed in a shape elongated in the left and right direction to correspond to the shape of the discharge port 17.

The blade 100 may include the main blade 110 and the sub-blade 120.

The main blade 110 may be disposed in the discharge port 17 to be rotatable by the driving motor 50. The main blade 110 may include the blocking plate 111 and the guide blade 112.

The blocking plate 111 may be elongated in the left and right direction to correspond to the shape of the discharge port 17. The blocking plate 111 may be formed in a bar shape elongated in the left and right direction. Referring to FIG. 7, the blocking plate 111 may be provided in a shape in which a thickness is gradually increased in the rotation direction R and then reduced again with respect to a cross section in a direction perpendicular to the rotation axis of the blade 100. In other words, the cross section of the blocking plate 111 may be provided in an approximate airfoil shape.

However, the cross section of the blocking plate 111 is not limited thereto and may be provided in various shapes capable of effectively blocking the airflow and capable of forming a blowing flow path 115 together with the guide blade 112 described later.

The guide blade 112 may be elongated in the left and right direction to correspond to the shape of the discharge port 17.

Referring to FIG. 7, the guide blade 112 may be spaced apart from the blocking plate 111 along the rotation direction R of the main blade 110. A distance between the guide blade 112 and the blocking plate 111 in the rotation direction R may be referred to as a first distance L1.

The guide blade 112 may form the blowing flow path 115 through the first distance L1 together with the blocking blade 100 according to the rotation angle of the main blade 110. In other words, according to the rotation angle of the main blade 110, the blowing flow path 115 through which heat-exchanged air is discharged to the outside of the housing 20 may be selectively formed.

Particularly, the blowing flow path 115 is not formed in a state in which the first distance L1 faces the inside of the housing 20. In a state in which the main blade 110 rotates and the first distance L1 is opened toward the discharge port 17, the blowing flow path 115 through which heat-exchanged air is discharged to the outside of the housing 20 may be formed (refer to FIGS. 11 to 13).

When the blowing flow path 115 is formed, the blowing flow path 115 may be formed in a tapered structure in which a width of the blowing flow path 115 is gradually reduced away from a center of the main blade 110 with respect to a radial direction of the main blade. Accordingly, the blowing flow path 115 may be formed so as to allow heat-exchanged air to be discharged from the inside of the housing 20 to the outside of the housing 20 by increasing a flow rate.

The guide blade 112 may include a plurality of sub-guide blades 112*s*. Each of the plurality of sub-guide blades 112*s* may be formed in a bar shape elongated in the left and right direction like the blocking plate 111.

The plurality of sub-guide blades 112*s* may be spaced apart from each other in the rotation direction R. Referring to FIG. 7, based on a cross section in a direction perpendicular to the rotation axis of the blade 100, each of the plurality of sub-guide blades 112*s* may be arranged to be inclined toward the distance, which is formed between the main blade 110 and the guide blade 112 with respect to the radial direction of the main blade 110, that is the first distance L1.

The sub-guide blade 112 are provided, for example, in such a way that an extension length of a cross section of the sub-guide blade 12 becomes shorter as the sub-guide blade 112 is away from the sub-guide blade 112 disposed in the middle, with respect to in the rotation direction of the main blade 110. With this structure, the above-described tapered structure may be formed together with the airfoil-shaped blocking plate 111.

Referring to FIG. 7, the guide blade 112 of the disclosure is composed of a total of three sub-guide blades 112, but the number of sub-guide blades 112 is not limited thereto. Three or more of sub-guide blades 112 may be provided.

Referring to FIGS. 6 and 7, the main blade 110 may further include the rotating plate 113 provided to fix both ends of the blocking plate 111 and the guide blade 112. The rotating plate 113 is provided, for example, in the shape of a disk. The rim of the rotating plate 113 may be provided to correspond to the circumference of the both ends of the main blade 110. The blocking plate 111 and the guide blade 112 may be fixed to the rotating plate 113 along the rim of the rotating plate 113.

Referring to FIG. 5, the sub-blades 120, like the main blades 110, may be elongated in the left and right direction to correspond to the shape of the discharge port 17. The sub-blade 120 may be formed in a bar shape elongated in the left and right direction.

The sub-blade 120 may be rotatably provided along the circumference of the main blade 110. Particularly, the sub-blade 120 may be rotatably provided along an outer rim of the rotating plate 113.

The sub-blade 120 may be disposed in the rotation direction R of the main blade 110 with respect to the blocking plate 111. The sub-blade 120 may be provided to cover the discharge port 17 together with the blocking plate 111 according to the rotation angle of the main blade 110.

The plurality of holes 120*h* is formed, for example, on the surface of the sub-blade 120. The plurality of holes 120*h* may be formed over the entire surface of the sub-blade 120. Alternatively, the plurality of holes 120*h* may be formed only on a part of the surface of the sub-blade 120.

The sub-blade 120 may be disposed in the rotation direction R with respect to the blocking plate 111 according to the rotation angle of the main blade 110 so as to cover the discharge port 17 together with the blocking plate. At this time, the air conditioner 1 may be provided to discharge air to the outside of the housing 20 at a low speed through the plurality of holes 120*h*. That is, the air conditioner 1 may discharge air to the outside of the housing while implementing the windless airflow through the plurality of holes 120*h* (refer to FIG. 11). A state in which the windless airflow is implemented will be described later in detail.

The sub-blade 120 is rotatably provided, for example, along the circumference of the main blade 110. Particularly, by interlocking with the main blade 110, the sub-blade 120 may be rotated along the circumference of the main blade 110. The main blade 110 may be configured to be rotated by the driving motor 50. The sub-blade 120 may be rotated by interlocking with the main blade 110 without a separate driving source.

Hereinafter the interlocking structure of the main blade 110 and the sub-blade 120 will be described in detail with reference to FIGS. 7 to 10.

Referring to FIG. 7, the sub-blades 120 may be spaced apart from each other in the radial direction from the circumference of the main blade 110. A distance between the circumferences of the sub-blade 120 and the main blade 110 may be referred to as a second distance L2.

Referring to FIGS. 7 and 8, the main blade 110 may further include a first interlocking part 114 protruding in the radial direction from the main blade 110 toward the sub-blade 120. Particularly, the first interlocking part 114 may protrude from the rim of the rotating plate 113. The first interlocking part 114 may protrude radially from the rim of the rotating plate 113 to correspond to the second distance.

The sub-blade 120 further includes a second interlocking part 121 protruding from the sub-blade 120 and provided to correspond to the first interlocking part 114. Particularly, the second interlocking part 121 may protrude toward the main blade 110 from an inner surface of the sub-blade 120 facing the main blade 110.

In order not to disturb the flow of heat-exchanged air, the first interlocking part 114 may be formed on the rim of the rotating plate 113 disposed at the both ends of the main blade 110. The second interlocking part 121 may be formed at both ends of the sub-blade 120 to correspond to the first interlocking part 114 protruding from the rotating plate 113.

Referring to FIG. 10, for the structural rigidity, the first interlocking part 114 may extend a predetermined length along the extension direction of the main blade 110. The second interlocking part 121 may extend a predetermined length along the extension direction of the sub-blade 120.

Referring to FIGS. 7 and 10, in order to limit an interlocking range of the sub-blade 120 with respect to the main blade 110, the second interlocking part 121 may be provided plurality.

Particularly, the second interlocking part 121 may include a first protrusion 121*a* and a second protrusion 121*b*. The first protrusion 121*a* and the second protrusion 121*b* may have shapes corresponding to each other.

The first protrusion 121*a* and the second protrusion 121*b* may be provided to allow the main blade 110 and the sub-blade 120 to interlock with each other only within a predetermined range of the rotation angle of the main blade 110. The first protrusion 121*a* and the second protrusion 121*b* may be spaced apart in the rotation direction R of the main blade 110. A distance between the first protrusion 121*a* and the second protrusion 121*b* in the rotation direction R of the main blade 110 may be referred to as a third distance L3.

Referring to FIG. 7, the first interlocking part 114 may be located between the first protrusion 121*a* and the second protrusion 121*b* of the second interlocking part 121, and the first interlocking part 114 may be provided to allow the main blade 110 and the sub-blade 120 to interlock with each other.

The rotation direction R of the main blade 110 may include a first direction R1 and a second direction R2. As will be described later, the first direction R1 may be defined as a direction in which the main blade 110 rotates to open the discharge port 17. The second direction R2 may be opposite to the first direction R1 and may be defined as a direction in which the main blade 110 rotates to close the discharge port 17 to form the windless airflow.

When the main blade 110 rotates in the first direction R1, the first interlocking part 114 may interlock with the first protrusion 121*a*. When the main blade 110 rotates in the second direction R2, the first interlocking part 114 may interlock with the second protrusion 121*b*.

Referring to FIGS. 7 and 8, the main blade 110 may include the connector protruding from the both ends of the main blade 110. Particularly, the main blade 110 may further include a connector protruding from the rotating plate 113 disposed at the both ends of the main blade 110.

The connector protruding from the both ends of the main blade 110 may be referred to as a first connector 116. The first connector 116 may be connected to the rotation shaft of the driving motor 50. The driving motor 50 may rotate the main blade 110. However, because the driving motor 50 is disposed on either side of both ends of the main blade 110 as described above, the first connector 116 may also be formed only at a position corresponding to one driving motor 50.

The first connector 116 of the main blade 110 may be directly connected to the rotation shaft of the driving motor 50, but may be connected through a coupler 51 as shown in FIG. 4. One end of the coupler 51 may be inserted and fixed into a groove 116*a* formed in the first connector 116, and the other end of the coupler 51 may be connected to the rotation shaft of the driving motor 50.

The coupler 51 may include a blade coupler 51*a* and a motor coupler 51*b*. The blade coupler 51*a* may be inserted into the groove 116*a* formed in the first connector 116. The blade coupler 51*a* may be provided in a polyhedral shape. The groove 116*a* formed in the first connector 116 may be formed to correspond to an edge of the outer circumference of the blade coupler 51*a*. An inner surface of the groove 116*a* formed in the first connector 116 may be provided to engage with the outer circumference of the blade coupler 51*a*, and both components may be engaged with each other.

The motor coupler 51*b* may be fixed to the shaft of the driving motor 50 so as to rotate together with the shaft of the driving motor 50. A blade coupler groove 51*aa* may be provided on one side of the blade coupler 51*a*, and the motor coupler 51*b* may be provided with a key corresponding to the blade coupler groove 51*aa* to be partially inserted into and fixed to the blade coupler 51*a*. The motor coupler 51*b* may be provided in a substantially cylindrical shape. The key corresponding to the blade coupler groove 51*aa* may protrude from one side of the motor coupler 51*b*. A blade coupler groove 51*bb* into which the shaft of the driving motor 50 is inserted and fixed may be formed on the other side of the motor coupler 51*b*.

The blade coupler 51*a* may be formed of a silicon material. The motor coupler 51*b* may be formed of a metal material or acrylonitrile butadiene styrene copolymer (ABS) resin. Because the blade coupler 51*a* is formed of silicon, it is possible to prevent the abrasion of the motor coupler 51*b* so as to improve durability, and to reduce noise that is generated while the driving motor 50 rotates the blade 100.

However, the blade coupler 51*a* or the motor coupler 51*b* is not limited to the above-described shape and material.

The sub-blade 120 further includes a second connector 122 including a hole 122*a* into which the first connector 116 is inserted. The second connector 122 may extend from the both ends of the sub-blade 120 and be connected to the first connector 116. The second connector 122 may have a length corresponding to a radial length of the rotating plate 113 of the main blade 110.

An inside of the hole 122*a* of the second connector 122 may be provided to be in contact with an outside of the first connector 116. In other words, the outside of the first connector 116 may be seated on the inside of the hole 122*a* of the second connector 122 without gaps.

Through the second connector 122, the sub-blade 120 is rotatably connected, for example, to the first connector 116 protruding from the rotating plate 113 of the main blade 110. With this structure, the sub-blade 120 may be rotated along the circumference of the main blade 110. The sub-blade 120 may be rotated along the outer rim of the rotating plate 113.

The air conditioner 1 may further include a damper 130 provided to limit rotational motion of the sub-blade 120. The damper 130 may be provided to apply a force to the sub-blade 120 in a direction opposite to the rotation direction of the sub-blade 120.

The second connector 122 of the sub-blade 120 may include teeth 122*b* formed along the rim of the hole 122*a*. The damper 130 may include a gear 131 meshing with the teeth 122*b*. The gear 131 of the damper 130 may be connected to a shaft protruding from the housing inner sidewall 20*a* to maintain engagement with the teeth 112*b* of the second connector 122.

As the gear 131 of the damper 130 and the teeth 112*b* of the second connector 122 are always engaged regardless of the rotational state of the main blade 110, the damper 130 may maintain the position of the sub-blade 120 that is stopped after being moved by the rotation of the main blade 110.

The air conditioner 1 may further include a stopper (not shown) provided to limit rotational motion of the sub-blade 120. The stopper (not shown) may protrude from the housing inner sidewall 20*a* and may be positioned on a rotation path of the sub-blade 120.

Figure 11:
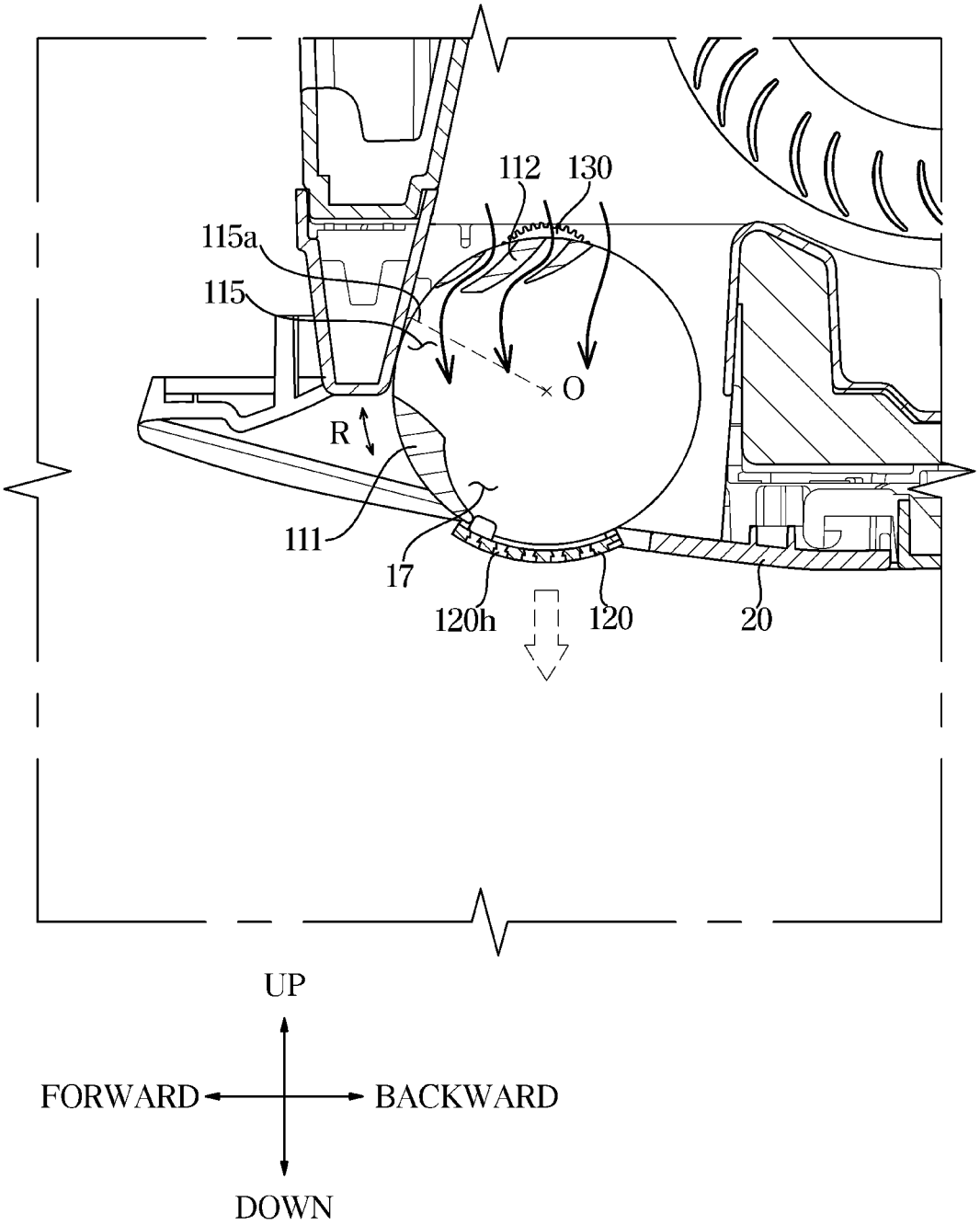
FIG. 11 is an enlarged cross-sectional view of a blade and a housing in a first mode in a cross-section of an air conditioner according to an embodiment of the disclosure.

FIG. 11 is an enlarged cross-sectional view of the blade and the housing in a first mode in a cross-section of the air conditioner according to an embodiment of the disclosure.

Figure 12:
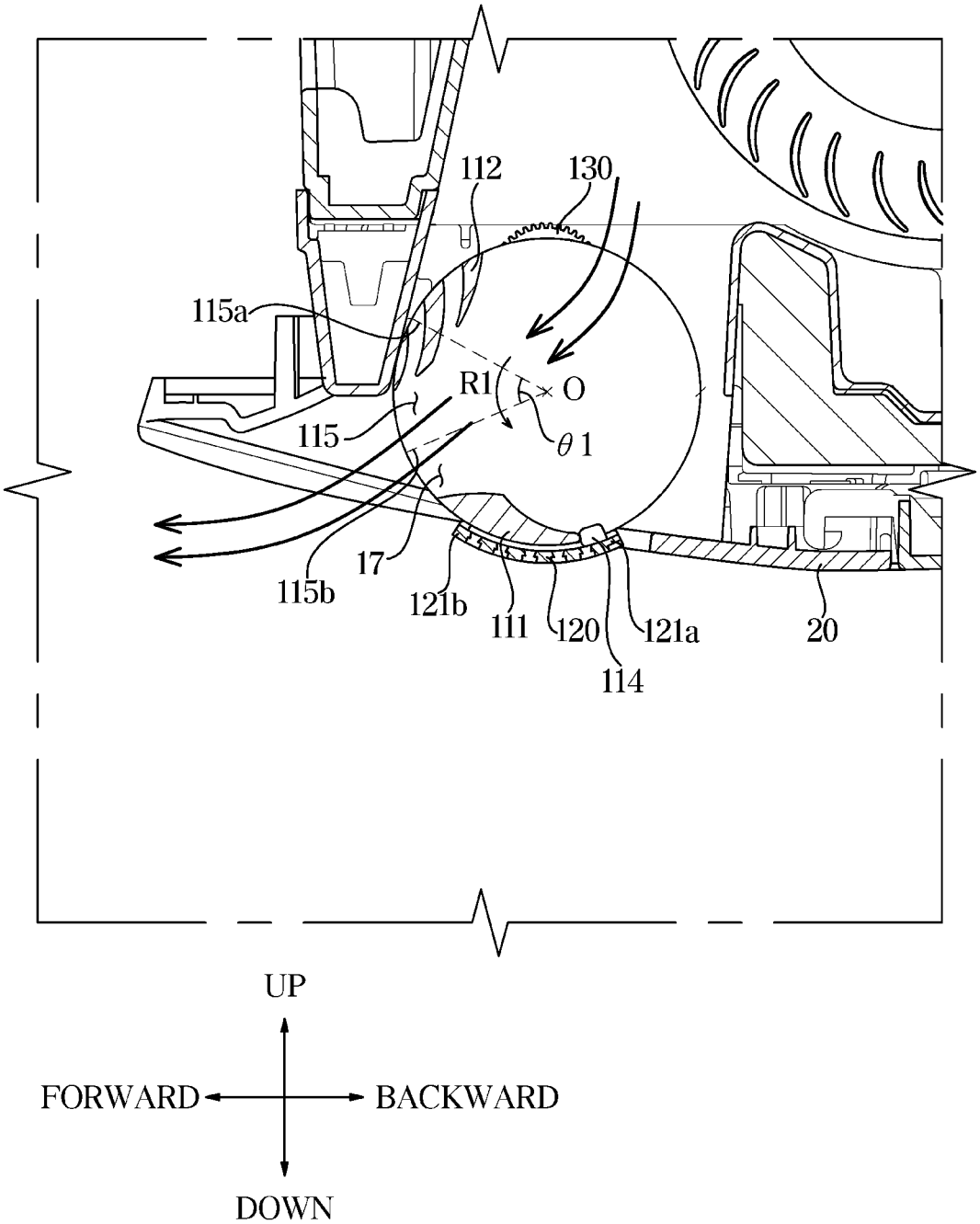
FIG. 12 is an enlarged cross-sectional view of a blade and a housing in a second mode in the cross-section of an air conditioner according to an embodiment of the disclosure.

FIG. 12 is an enlarged cross-sectional view of the blade and the housing in a second mode in the cross-section of the air conditioner according to an embodiment of the disclosure.

Figure 13:
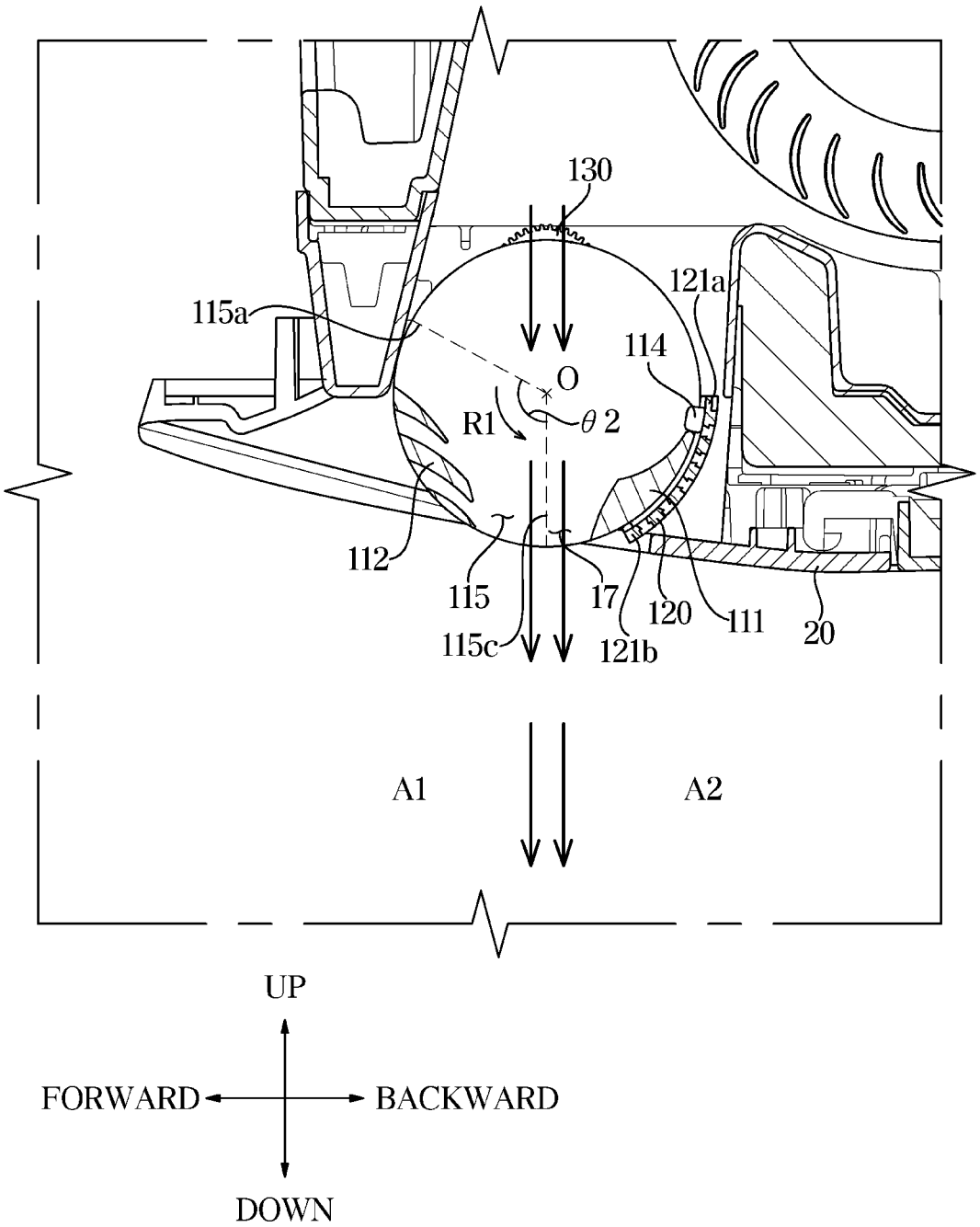
FIG. 13 is an enlarged cross-sectional view of a blade and a housing in a third mode in the cross-section of an air conditioner according to an embodiment of the disclosure.

FIG. 13 is an enlarged cross-sectional view of the blade and the housing in a third mode in the cross-section of the air conditioner according to an embodiment of the disclosure.

Hereinafter a blowing mode according to the rotation angle of the main blade 110 will be described in detail. In the specific structure of the blade 100, the same information as the above description will be omitted.

Referring to FIG. 11, a state in which the discharge port 17 is completely covered by the blocking plate 111 and the sub-blade 120 may be defined as a first mode. In the first mode, a contact state between the first interlocking part 114 and the second protrusion 121*b* of the second interlocking part 121 may be maintained.

Because the blocking plate 111 and the sub-blade 120 cover the discharge port 17 in the first mode, the heat-exchanged air may be inevitably discharged to the outside of the housing 20 through the plurality of holes of the sub-blade 120. Therefore, in the first mode, the air may be discharged to the outside of the housing 20 at a low speed through the plurality of holes 120*h*.

Referring to FIG. 12, a state in which the main blade 110 is rotated by a first angle θ1 in the first direction R1 based on the position in the first mode may be defined as a second mode.

In the second mode, the blocking plate 111 may be provided to overlap the sub-blade 120. At this time, the blowing flow path 115 may be opened toward the discharge port 17 to discharge air to the outside of the housing 20.

Particularly, the air discharged from the blowing fan 40 may flow toward the inside of the main blade 110. As described above, each of the plurality of sub-guide blades 112*s* may be inclined in a direction toward the first distance L1 formed between the blocking plate 111 and the guide blade 112 based on the radial direction. Therefore, in the second mode, the air discharged from the blowing fan 40 may be guided along the guide blade 112 and the blocking plate 111 and thus the air may be intensively discharged toward a region between the front side and the lower side of the air conditioner 1.

Referring to FIG. 13, a state in which the main blade 110 is rotated by a second angle θ2 in the first direction R1 based on the position in the first mode may be defined as a third mode.

In the third mode, the blowing flow path 115 may be provided to open toward the discharge port 17 to allow the heat-exchanged air to be discharged to the direct downward direction of the air conditioner 1.

In a process in which the main blade 110 is rotated from the first angle θ1 to the second angle θ2, the first interlocking part 114 may press the first protrusion 121*a* of the second interlocking part 121 toward the first direction R1. In the process in which the main blade 110 is rotated from the first angle θ1 to the second angle θ2, the blocking plate 111 and the sub-blade 120 may be provided to rotate together in an overlapped state.

In the third mode, the main blade 110 may be accommodated inside the housing 20 while overlapping with the sub-blade 120.

When the third mode is changed to the first mode or the second mode, the driving motor 50 may rotate the main blade 110 in the second direction R2 opposite to the first direction R1. During this process, the first interlocking part 114 may press the second protrusion 121*b* of the second interlocking part 121 toward the second direction R2. That is, the above-described reverse operation in the first direction R1 is performed, and finally, it may be returned to the first mode in which the first interlocking part 114 of the first mode and the second protrusion 121*b* of the second interlocking part 121 are in contact with each other.

Referring to FIG. 13, in the air conditioner 1 installed on the ceiling, when the air conditioner 1 is operated in the third mode by the above structure, it is possible to generate the strong airflow that is in the direct downward direction of the air conditioner 1 and that corresponds to the width of the discharge port 17.

Particularly, the air discharged from the blowing fan 40 may flow toward the inside of the main blade 110. As described above, each of the plurality of sub-guide blades 112*s* may be inclined in a direction toward the first distance L1 formed between the blocking plate 111 and the guide blade 112 based on the radial direction. Therefore, in the third mode, the air discharged from the blowing fan 40 may be guided along the guide blade 112 and the blocking plate 111 and thus the air may be intensively discharged to the direct downward direction of the air conditioner 1. Because the air flows between the guide blade 112 and the blocking plate 111, the air discharged to the outside of the air conditioner 1 may be concentrated and flow at a faster flow rate than when the air is guided by one plate-shaped blade.

The air may be intensively discharged in the direct downward direction (air curtain structure), and thus the space may be partitioned in the forward and backward directions based on the flow of the discharged air (A1, and A2). A user can set heating and cooling under different conditions in the partitioned spaces A1 and A2. For more effective cooling and heating, a plurality of air conditioners including the above-described structure of the blade 100 may be arranged in parallel and used.

By using the above-described structure of the blade 100 of the air conditioner 1, the main blade 110 and the sub-blade 120 may be rotatably coupled to form a cylinder shape as a whole, and through the simple structure, the air conditioner 1 may effectively control the discharge direction of the air. Further, it is possible to easily implement the air curtain state in which air is intensively discharged in the direct downward direction in comparison with the plate-shaped blade structure.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An air conditioner comprising:

a housing comprising a discharge port;

a fan disposed inside the housing to blow air into the discharge port;

a main blade disposed in the discharge port to be rotatable by a driving motor, the main blade comprising a blocking plate and a guide blade arranged at a first distance from the blocking plate along a rotation direction of the main blade so as to form a blowing flow path through the first distance according to a rotation angle of the main blade; and a sub-blade configured to be rotated along a circumference of the main blade by interlocking with the main blade, the sub-blade arranged in the rotation direction of the main blade with respect to the blocking plate and provided to cover the discharge port together with the blocking plate according to the rotation angle of the main blade.

2. The air conditioner of claim 1, wherein the sub-blade comprises a plurality of holes through which the air is discharged to an outside of the housing.

3. The air conditioner of claim 2, wherein air is discharged to an outside of the housing at a low speed through the plurality of holes in a first mode in which the blocking plate and the sub-blade cover the discharge port.

4. The air conditioner of claim 1, wherein the main blade is provided to allow the blocking plate to overlap the sub-blade in a second mode in which the main blade is rotated by a first angle in a first direction, and wherein the blowing flow path is opened toward the discharge port to discharge air to an outside of the housing.

5. The air conditioner of claim 4, wherein the blowing flow path is opened toward the discharge port to allow air to be discharged directly downward from the air conditioner in a third mode in which the main blade is rotated by a second angle in the first direction.

6. The air conditioner of claim 5, wherein in a process in which the main blade is rotated from the first angle to the second angle, the main blade interlocks with the sub-blade to rotate the sub-blade in the first direction.

7. The air conditioner of claim 5, wherein in a process in which the main blade is rotated from the first angle to the second angle, the blocking plate and the sub-blade are rotated together in an overlapped state, and wherein in the third mode, the main blade is accommodated inside the housing while overlapping the sub-blade.

8. The air conditioner of claim 1, wherein the guide blade comprises a plurality of sub-guide blades, wherein the plurality of sub-guide blades is spaced apart from each other by a predetermined distance in the rotation direction, and wherein each of the plurality of sub-guide blades is inclined in a direction toward a distance formed between the blocking plate and the guide blade based on a radial direction.

9. The air conditioner of claim 8, wherein the sub-blade is arranged at a second distance in the radial direction from an outer circumference of the main blade;

wherein the main blade further comprises a first interlocking part radially protruding from the main blade toward the sub-blade; and wherein the sub-blade further comprises a second interlocking part protruding from the sub-blade and provided to correspond to the first interlocking part, and wherein the first interlocking part protrudes to correspond to the second distance to allow the main blade and the sub-blade to interlock with each other.

10. The air conditioner of claim 9, wherein the second interlocking part comprises a first protrusion and a second protrusion, and wherein the first protrusion and the second protrusion are disposed at a third distance in the rotation direction of the main blade to allow the main blade and the sub-blade to interlock with each other within a predetermined range of the rotation angle of the main blade.

11. The air conditioner of claim 9, wherein the main blade further comprises a rotating plate provided to fix both ends of the blocking plate and the guide blade, and wherein a rim of the rotating plate is provided to correspond to circumferences of the both ends of the main blade.

12. The air conditioner of claim 11, wherein the first interlocking part protrudes from the rim of the rotating plate.

13. The air conditioner of claim 11, wherein the main blade further comprises a first connector protruding from the rotating plate and connected to a rotation shaft of the driving motor, wherein the sub-blade further comprises a second connector comprising a hole into which the first connector is inserted, the second connector connected to both ends of the sub-blade, and wherein an inner side of the hole of the second connector is in contact with an outer side of the first connector.

14. The air conditioner of claim 13, wherein the second connector further comprises teeth formed along a rim of the hole, wherein the air conditioner comprises a damper comprising a gear provided to engage with the teeth, and wherein the damper is provided to apply a force to the sub-blade in an opposite direction to a rotation direction of the sub-blade.

15. The air conditioner of claim 1, further comprising:

a stopper protruding from the housing and arranged on a rotation path of the sub-blade so as to limit rotation of the sub-blade.

* * * * *